US011478113B1

(12) United States Patent
Spraul

(10) Patent No.: US 11,478,113 B1
(45) Date of Patent: Oct. 25, 2022

(54) PIVOTING TOILET PAPER HOLDER

(71) Applicant: William Peter Spraul, Montgomery, NY (US)

(72) Inventor: William Peter Spraul, Montgomery, NY (US)

( * ) Notice: Subject to any disclaimer, the term of this patent is extended or adjusted under 35 U.S.C. 154(b) by 0 days.

(21) Appl. No.: 17/300,493

(22) Filed: Jul. 19, 2021

(51) Int. Cl.
*A47K 10/38* (2006.01)
*A47K 10/32* (2006.01)

(52) U.S. Cl.
CPC .. *A47K 10/3836* (2013.01); *A47K 2010/3253* (2013.01)

(58) Field of Classification Search
None
See application file for complete search history.

(56) References Cited

U.S. PATENT DOCUMENTS 4,824,038 A * 4/1989 Chandler ..... A47K 10/3836 242/598.2
D393,165 S * 4/1998 Jensen ..... D6/523
5,871,170 A * 2/1999 Morales ..... A47K 10/40 242/592
5,967,452 A * 10/1999 Wilder ..... A47K 10/3836 242/592
10,743,725 B2 * 8/2020 Scheimberg ..... A47K 10/22
2012/0181297 A1 * 7/2012 Cofrancesco ..... A47K 10/38 221/26
2020/0129016 A1 * 4/2020 Cuenca ..... A47K 10/22

FOREIGN PATENT DOCUMENTS

DE 195 45 440 * 12/1997

OTHER PUBLICATIONS

English Translation of Grammer (DE 195 45 440), Dec. 1997 (Year: 1997).*

* cited by examiner

*Primary Examiner* — William A. Rivera

(57) ABSTRACT

A pivoting toilet paper holder system providing easy access to toilet paper. The novel system uses a pivoting shaped arm and a stop assist. The system has embodiments, alternatives, and variations.

13 Claims, 12 Drawing Sheets

PIVOTING TOILET PAPER HOLDER

BACKGROUND OF THE INVENTION

1. Field of Invention

This invention is related to toilet paper holders and more specifically to a toilet paper dispensing system for providing easy access to a roll of toilet paper in challenging bathroom configurations.

2. Description of the Prior Art

One prominent challenging bathroom configuration is a small bathroom layout with dimensions 5 ft. by 8 ft. providing the 3 essential plumbing fixtures, a sink in a cabinet, a toilet, and a bathtub. The minimum code space for the toilet is a rectangle that is 30 in. in width which is parallel to the wall behind the toilet and 51 in. in length measured from the back of the wall forward beyond the end of the front of the toilet. This space is considered adequate for use of the toilet, but does not facilitate good placement for a toilet paper dispenser that would provide easy access to same. Where does the dispenser get mounted? One side is the bathtub with no place to mount a dispenser. A toilet paper holder mounted on the back wall is too far back to reach. A dispenser mounted on the side of a standard 21 in. width cabinet will at best be even with the shoulders of the user requiring the user to twist and turn to access the dispenser. The use of a toilet paper holder stand takes up floor space, it must be moved to clean the floor and most important is where to place it so as not to interfere with use of other fixtures. This dilemma has generated a number of patents to address this problem. Patents that are related to the present invention include the U.S. Pat. Nos. 1,226,463, 5,868,345, 6,405,971, 6,527,219, 5,871,170, 5,967,452, 10,743,725 B2 and U.S. Pat. No. 7,306,185B1. The related patents above are similar in design using sliding, pivoting, flexible and telescoping mechanisms. The mechanisms are substantial and in a minimum space application either require the user to twist and turn to extend the mechanism if the user is seated first or interfere with a user trying to sit down if the mechanism is extended. The above patents have shortcomings when it comes to solving the problem of providing easy access to toilet paper in minimum space situations.

BRIEF SUMMARY OF THE INVENTION

The object of this invention is a toilet paper dispensing system that can in a challenging bathroom configuration enable a person to, without having to twist and turn, easily obtain toilet paper. This objective is very important and needed. There are many small bathrooms where space for a toilet is at the code minimum, a rectangle with dimensions of 30 in. by 51 in. People who do not possess the ability to twist and turn, due to their size, age, arthritis, being handicapped and other reasons, securing toilet paper in a small bathroom can be a very distressing situation.

The present invention meets the objective stated above by removing the toilet paper dispenser completely of the out of the path for a person to sit down easily, and at the same time places the toilet paper in an ideal position to obtain the toilet paper. This is accomplished with a novel pivoting action structure. The toilet paper is initially at rest in the nonuse position on the side of the cabinet that is next to the toilet. For a minimum code space situation, a novel L shaped arm is used. One end of the arm is hinged to a base that is mounted on the side of the cabinet. The other end of the arm has a toilet paper support connected. Starting from the nonuse position the toilet paper is easily pivoted with the touch of the user's finger and comes to a stop in an ideal position that is forward and around the corner of the cabinet. There are a number of embodiments, alternatives and variations of the present invention. Where space is not restricted, the toilet paper may be too far away from the user. A straight or reverse L arm with a modified base would be used to place the toilet paper in the appropriate ideal position, close and forward from the nonuse position. When in the ideal position, the user can obtain the amount of toilet paper desired, stop the roll and tear it off using only one hand without having the paper continuing to roll and spew more paper out. This is made possible by a the novel stop assist using a plurality of pegs. A second toilet paper roll if desired can be attached and pivots to ideal position with the primary roll. The system is small in size, takes up no floor space and is inexpensive to make.

BRIEF DESCRIPTION OF DRAWINGS

FIG. 1B top view of the integral hinge.

DETAILED DESCRIPTION OF THE INVENTION

The following description of the preferred embodiments of the invention is intended to enable one skilled in the prior art to make and use this invention, but is not intended to limit the invention to these embodiments, alternatives and variations.

Figure 1:
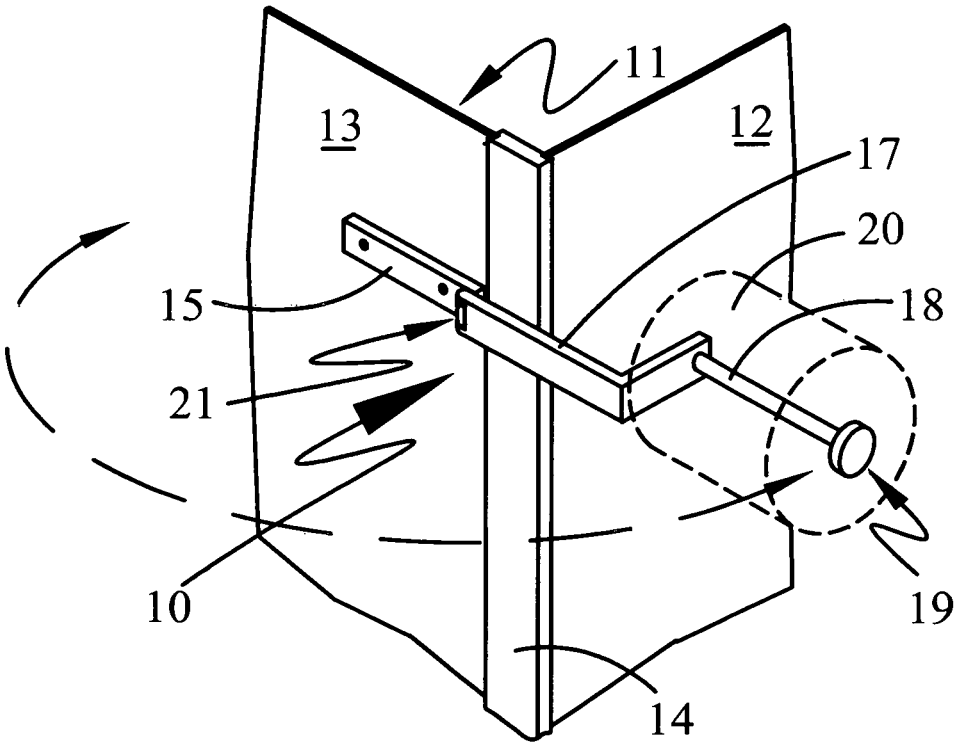
FIG. 1 is a perspective view of the preferred embodiment in the use position.
Figure 1A:
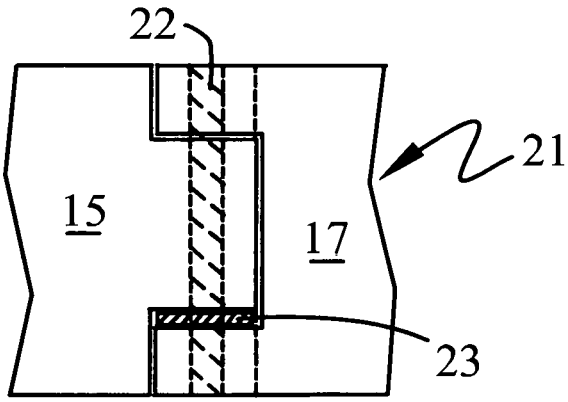
FIG. 1A side view of the integral hinge.
Figure 1B:
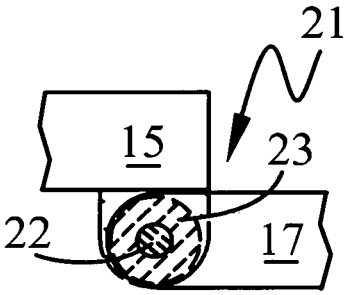

Referring to FIGS. 1, 1A, 1B, an illustration of the preferred embodiment described herein the pivoting toilet paper holder system using a novel pivoting action system 10, shown in the use position with arrows describing the directions of movement, comprises a base 15 which is mounted to the left side 13 of cabinet 11. The base 15 has connected to it an L-shaped arm structure 17 using an integral hinge 21 constructed from the proximal end of the base 15, the proximal end of the arm 17, a friction washer 23, and the pivot pin 22 as detailed in FIGS. 1A and 1B. The arm 17 has a L shaped bend between the proximal end and the distal end. The distal end of the arm 17 has the proximal end of a toilet paper roll support 18 connected.

The distal end of the support 18 has a novel stop assist 19 connected to it. The support 18 should be long enough in length to hold a toilet paper roll 20 with an additional amount of length added for the roll 20 to roll freely with consideration for the proper operation of the stop assist 19 shown in FIG. 1. Operation of the stop assist 19 will be described later in the detailed description.

FIG. 1A and FIG. 1B shows the integral hinge 21, from the side and top view respectively, created by the proximal end of the base 15 and the proximal end of the arm 17. FIG. 1A and FIG. 1B show the pivot pin 22 which is the pivoting point for the system 10 and the friction washer 23.

The system 10 has a nonuse and a use position. There are many methods and approaches to insure the system will stay in the desired positions, nonuse and use. The weight alone of the arm 17, the support 18, the stop assist 19 and roll 20 will cause resistance to the pivoting action if made without the friction washer 23 that is shown in FIGS. 1A, 1B. This resistance alone may be enough to prevent wandering out of the desired positions. FIG. 1A, 1B shows the hinge 21 made with the friction washer 23 that provides increased resistance to the pivoting action to aid in holding desired positions. Later in the detailed description other methods will be described to also have the system hold the nonuse and use positions properly.

FIG. 1B is a top view of the hinge 21 showing the pivot pin 22. Referring to FIG. 1, the system using the integral hinge 21 pivots the roll 20 to the front of the cabinet 12. In FIG. 1B the arm 17 is in the use position and further pivoting is stopped when the arm 17 contacts the base 15. The integral hinge 21 made as shown in FIG. 1B provides the arm 17 clearance to get around the corner of the cabinet 14 as shown in FIG. 1. Not all cabinets have a corner 14 reveal protruding out. The system 10 can be connected to a wall and other vertical structures.

Figure 2:
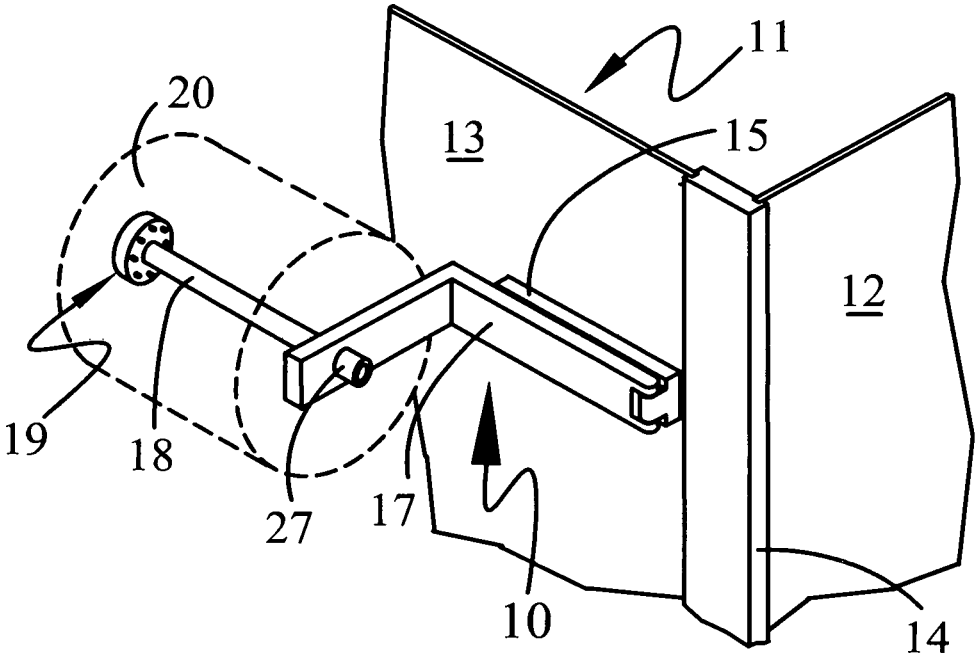
FIG. 2 perspective view of the preferred embodiment in the nonuse position.
Figure 2A:
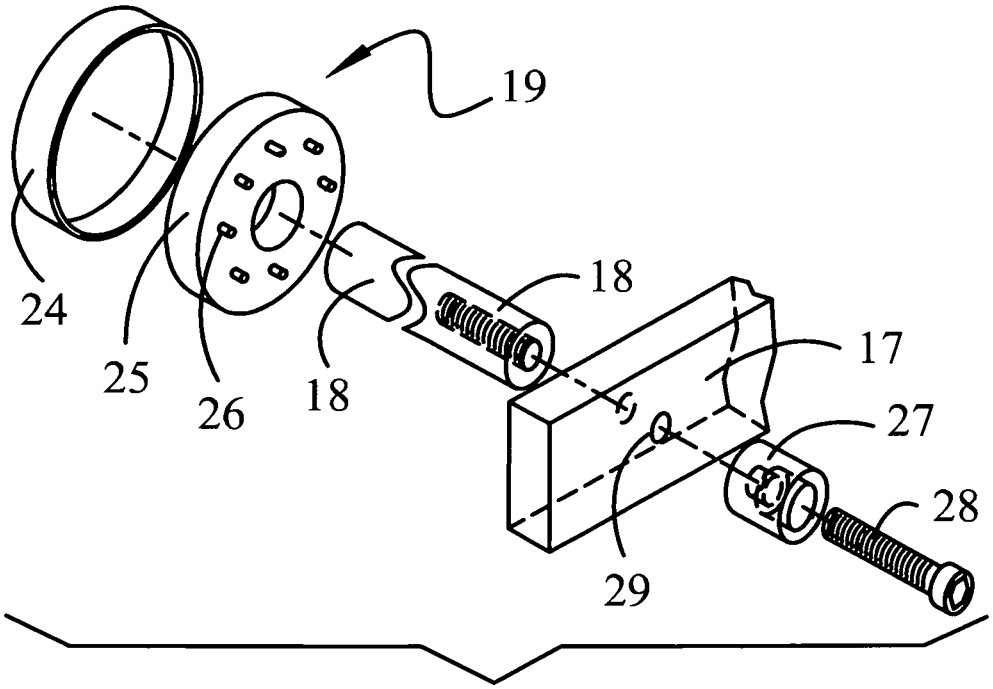
FIG. 2A exploded view of the stop assist (SA).

In FIG. 2 the system 10 is in the nonuse position. This would be the position when the toilet paper does not need to be accessed. When a user needs to use the toilet, the user would pivot the system 10 by putting their finger on the pivoting push knob 27 and push in the direction of the toilet and continue to push until it reaches the use position. The user would use the same knob 27 to pivot the system 10 back into the nonuse position. In FIG. 2A the support 18 is connected to the arm 17 by an Allen screw 28 that passes through the knob 27, then continues on to pass through the hole 29 that is in distal end of arm 17 and screws into the threads in the proximal end of support 18. Any surface on the arm 17 could be used to pivot the arm 17. The pivoting push knob 27 provides a designated surface to use to pivot the arm that can be easily kept clean.

In FIG. 2A the novel stop assist 19 is comprised of a stop ring 25 with a plurality of toilet paper stop pegs 26 that are embedded in to the inside of the ring 25 that faces arm 17, and a ring cap 24 that covers the ring 25 that can be made to be decor consistent with the system 10. The stop assist 19 diameter should be small enough so a roll 20 can easily be slipped over the stop assist 19 for installing and removing the roll 20. The stop assist 19 must also be large enough to prevent the roll 20 from falling off the support 18 during the pivoting action of the system 10 and also be large enough to have the plurality of pegs 26 to be positioned in stop assist 19 for proper operation of same. The ring 25 in this embodiment is made of hard rubber. The pegs 26 are rounded at the end so they do not pose a danger to the user. The ring 25 has a hole with the proper diameter in each position a peg 26 is to be embedded. The pegs 26 are then pushed into the holes. The ring 25 has a hole in the center with a diameter smaller than that of the support 18 so the ring 25 can be pushed on to the support 18 creating a secure fit. The ring 25 has an end cap 24 that has an inside diameter smaller than ring 25 such that the cap 24 will have a secure fit covering the ring 25. The support 18 length should be made to have a roll 20 freely roll without being contacted by any peg 26.

Figure 3:
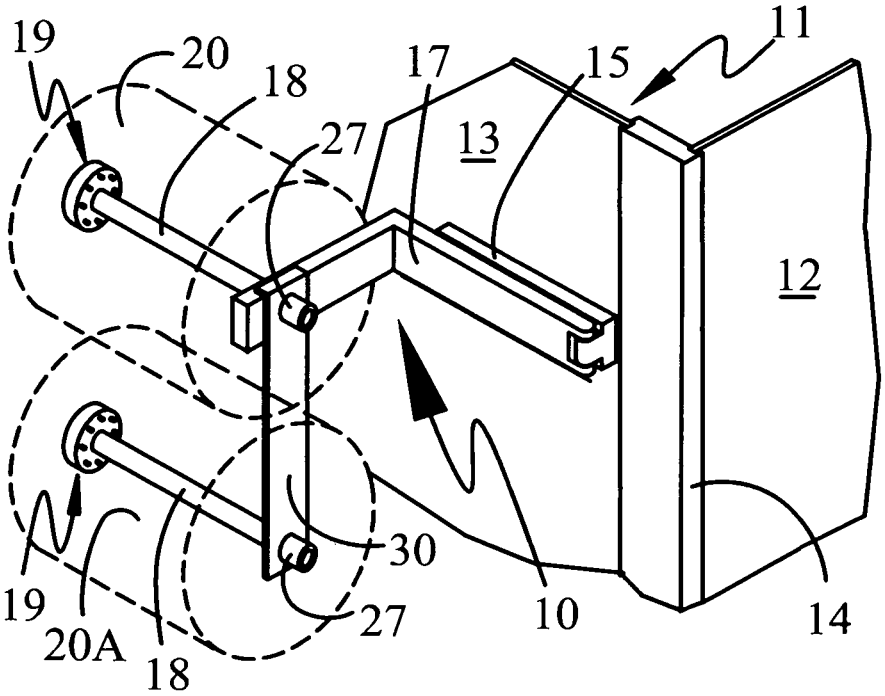
FIG. 3 perspective view of second toilet paper roll connected.
Figure 3A:
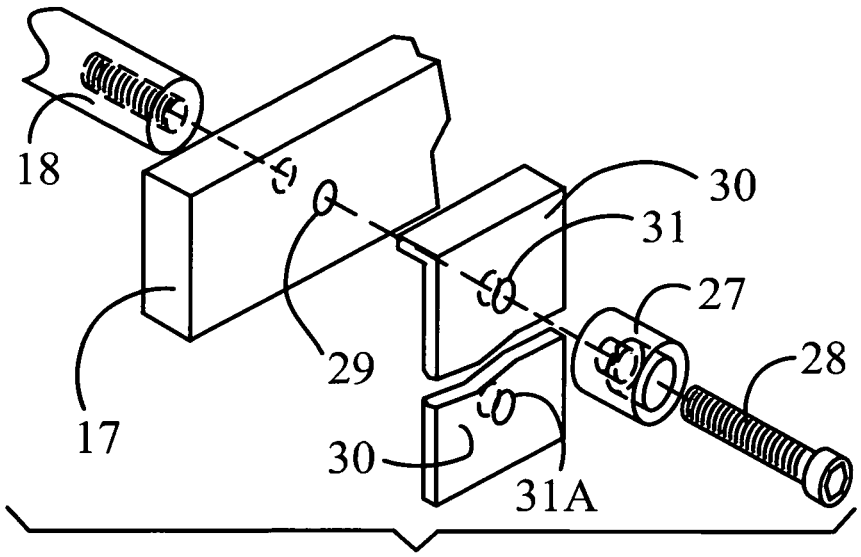
FIG. 3A exploded view of second toilet paper connector and knob.

FIG. 3 shows how a second toilet paper roll 20A can be connected to the pivoting system 10 that is mounted on the left side 13 of cabinet 11 which also has a a front 12. The second roll connector 30 connects to the arm 17. The connector 30 length is made long enough to have a second roll 20A below the roll 20 above it without interfering with each other, but short enough not to interfere with the toilet while the system 10 is pivoting. FIG. 3A shows the detail how connector 30 attaches to the arm 17. The connector 30 has a hole 31 in proximal end that lines up with hole 29 in the distal end of arm 17. Screw 28 passes through knob 27, then continues on to pass through hole 31 and 29 finally screwing into the threads at the proximal end of support 18. The length of screw 28 and the threads in the support 18 should be chosen to accommodate both a single roll system 10 and a single roll system 10 with the addition of a second roll connector 30 by allowing for the additional thickness of connector 30 that screw 28 will pass through. Connector 30 has a hole 31A at the distal end to connect the additional parts required to support second roll 20A. The additional parts that will be used to provide support for the second roll 20A could be the same parts used for the single roll system 10, specifically, support 18, stop assist 19, knob 27, and screw 28.

Figure 4:
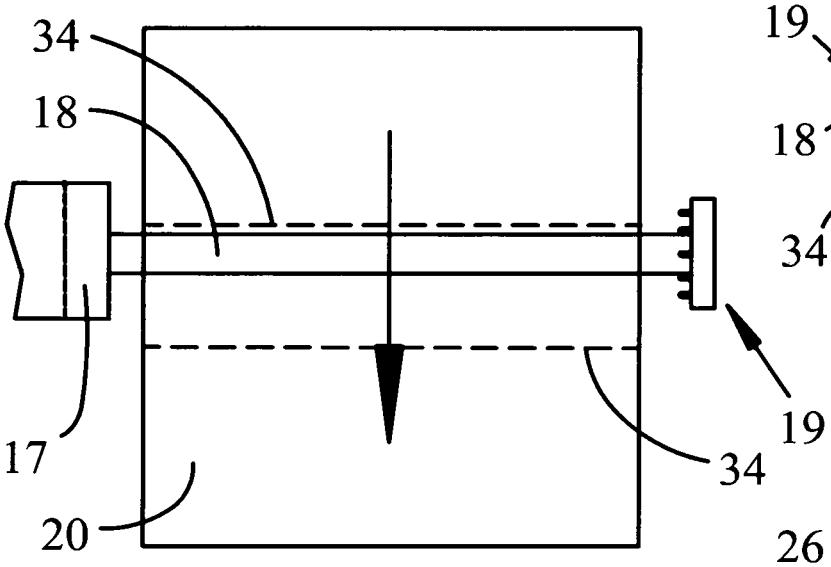
FIGS. 4, 4A, 4B, 4C, 4D illustrates operation of stop assist (SA).
Figure 4A:
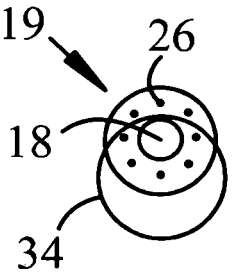
Figure 4B:
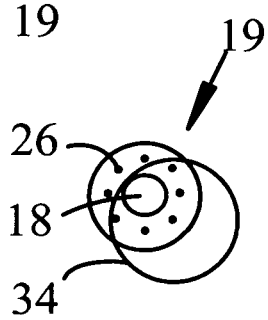
Figure 4D:
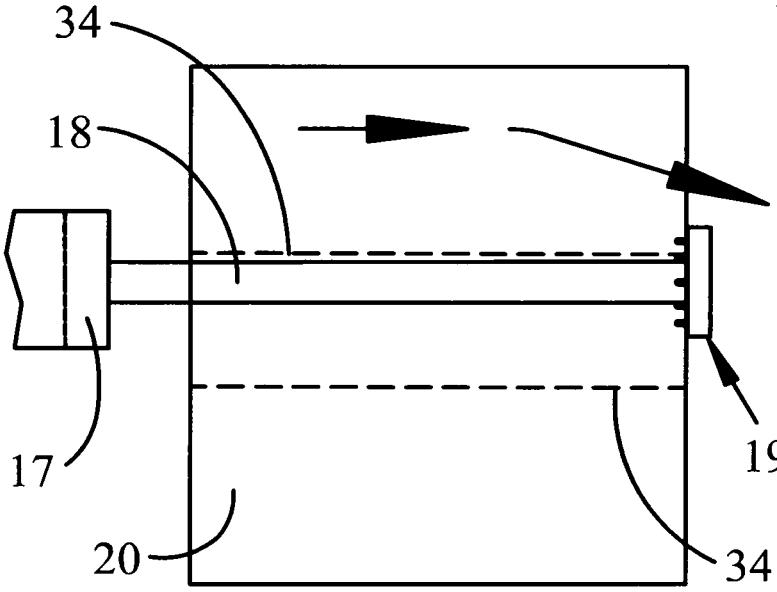

FIGS. 4-4D illustrate how the novel stop assist 19 operates and the relationship sizes of component parts. The toilet paper roll 20 has a center roll 34 made of cardboard that the toilet paper is wrapped around to form the toilet paper roll 20. The diameter of the stop assist 19 should be smaller than the diameter of the center roll 34 so the toilet roll 20 can easily be slipped over the stop assist 19 for installation and removal of roll 20 on the support 18. The stop assist 19 diameter should be large enough to stop the roll 20 from falling off while the system 10 is pivoting and also be large enough to have the plurality of pegs 26 to be positioned in stop assist 19 for proper operation of same.

In FIG. 4 the length of the support 18 adequately gives room for the roll 20 to freely roll without coming in contact with the pegs 26. The user operation would start with the roll 20 being closer to the arm 17 rather than other end of support 18 as in FIG. 4. Then user would pull the toilet paper 20 in the direction indicated by the arrow in FIG. 4 until the desired amount had been reached. Then, as shown in FIG. 4D, the user, with a finger, would slide the roll 20 towards and into the pegs 26 as indicated by the arrow. Finally, the user would tear off the paper in the direction of the following arrow. The user, most likely, will learn that the operation of sliding the roll 20 into the pegs 26 and tearing the paper can be accomplished in one motion.

Figure 4C:
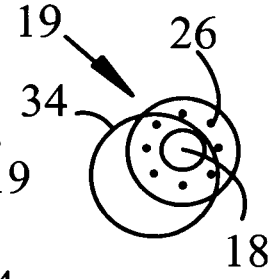

In FIGS. 4A-4C, the physical relationship between the center roll 34, the support 18 and the stop assist 19 containing the pegs 26 is illustrated. A plurality of pegs 26 is needed in the stop assist 19 for proper and effective operation. The illustration shows a finite number of pegs 26 for this discussion but, it is not meant to suggest this is the correct number to be used. FIG. 4A shows after the roll 20 has been slid towards the stop assist 19, only the top most 3 pegs 26 actually engaged with the toilet paper roll 20 in this particular case. It may appear that only the top 3 pegs 26 are needed. FIGS. 4B and 4C illustrates the effect of a user that has learned the single motion of pulling the paper towards the stopper 19 and tearing off the paper in one motion, especially when the roll 20 is getting closer to empty and lighter in weight. The center roll 34 shifts about the support 18 with the result that different pegs 26 will engage the paper than in FIG. 4A. Further, when the toilet paper roll 20 is very close to empty the roll 20 may jump so much that the pegs 26 on the bottom will be the ones that will penetrate the roll 20. That is why pegs 26 should be mounted around the entire ring 25. The pegs 26 should be rounded at the ends so they will not pose a danger to anyone.

Figure 5A:
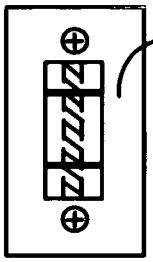
FIGS. 5, 5A, 5C, 5D, 5E, 5F illustrates hinge base shim to hold positions.
Figure 5B:
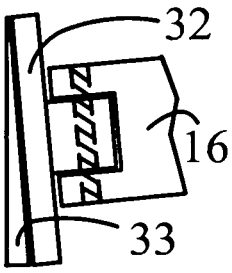
Figure 5:
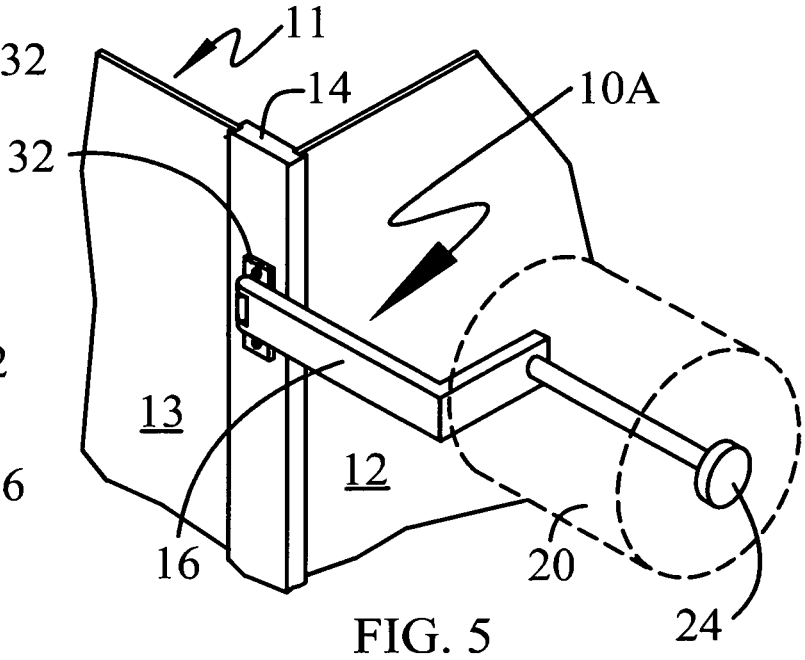
Figure 5C:
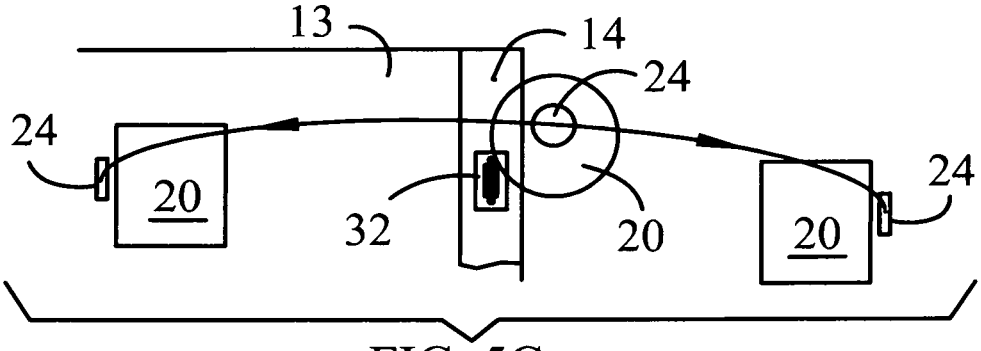
Figure 5D:
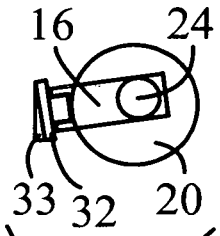
Figure 5E:
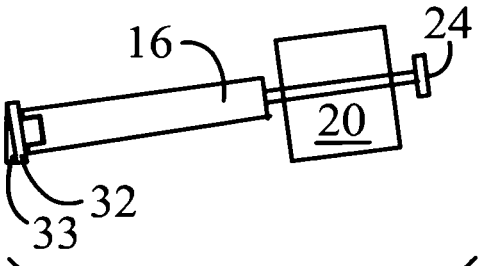
Figure 5F:
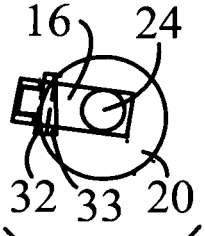

Earlier in FIG. 1A it was stated there are many methods and approaches to insure the system will stay in the desired positions. Two were described. One was the weight alone of the pivoting arm 17 may be sufficient to have the positions held. In FIGS. 1A, 1B, a friction washer 23 is shown installed that increases resistance. A third way to have the system stay in the desired positions is with the use of gravity. In FIGS. 5, 5A, 5B, system 10A is the same as system 10 in FIG. 1, except for the hinge base 32, the hinge base shim 33, and the base hinge arm 16. The base 32 is mounted on the corner 14 of cabinet 11. The pivoting arm 16 is shown in the use position which is in front 12 of the cabinet 11. The base 32 in FIGS. 5A, and 5B, does not have the friction washer 23 as in FIG. 1A, 1B, in that arm 16 should pivot freely with the least amount of resistance as possible. In FIG. 5B a shim 33 moves the bottom of base 32. The top of base 32 does not move. The effect on the system 10A is shown in FIGS. 5D, 5E, and 5F. In FIG. 5D the system 10A is in the nonuse position next to the left side 13 of the cabinet 11 and the view is the end of system 10A. The distal end of arm 16 is slanted up from where it would be without the shim 33 installed. The ring cap 24 is also higher. In FIG. 5F the system is in the use position and the view is the end of system 10A. The distal end of arm 16 is now in the opposite position of the view in FIG. 5D. The arm 16 is slanted down and the ring cap 24 is down. In FIG. 5E the system 10A is in the middle of the pivoting travel from use to nonuse positions. The arm 16 is facing outward from the corner 14 of the cabinet. The view is the end of system 10A. Both the arm 16 and the ring cap 24 are higher than that in FIG. 5D and FIG. 5F. The 3 positions just described are shown in FIG. 5C. The arrows show the pivoting travel between the use and nonuse positions. Since the ring cap 24 in both use and nonuse positions are lower than when the user starts to push the system, if the user stops pushing, gravity will pivot the system 10A to one of the desired positions and keep it there. This permits the user to simply push the arm 16 pass the high point toward the desired position and let go. The system will go to the desired position and stay there. The base 32 used in this description and illustration is different than the base 15 in the preferred embodiment. Please note that pivoting toilet paper holder system 10 is shown with a number of different bases throughout the detailed description to show variations. All of the systems shown could use the gravity method of holding positions by tilting the system either by using a shim or by building the tilt into the base itself.

Figure 6:
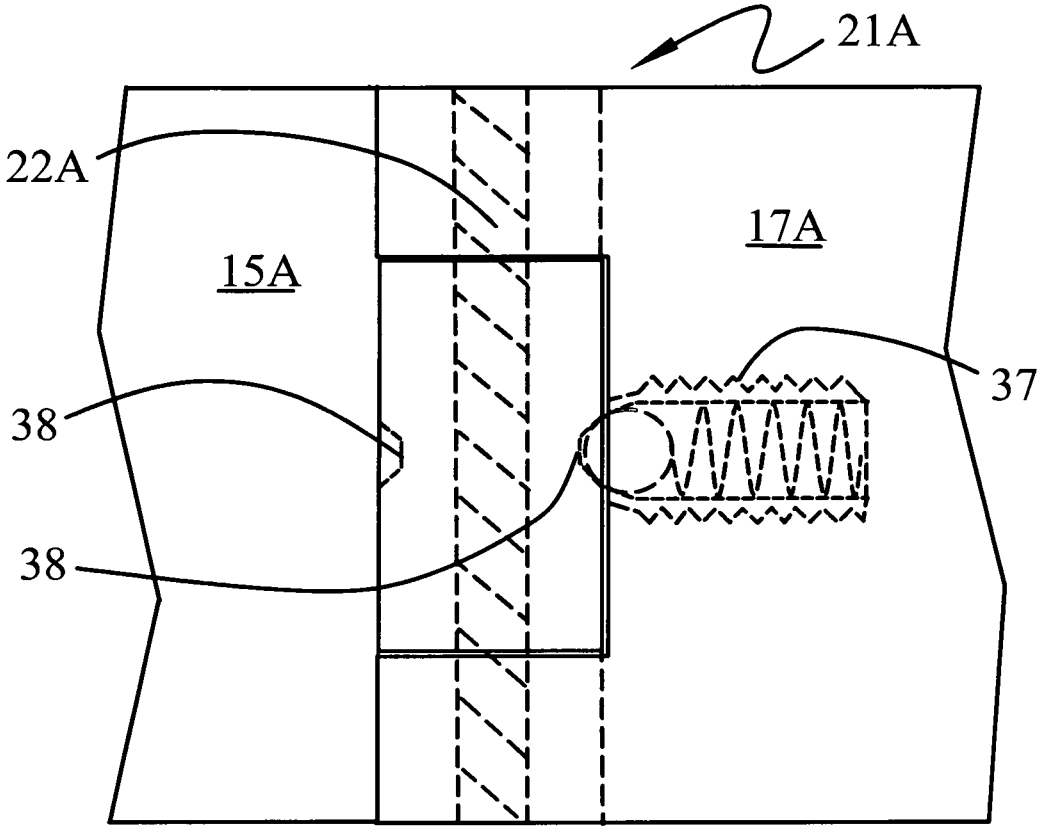
FIGS. 6, 6A illustrates ball spring plunger to hold positions.
Figure 6A:
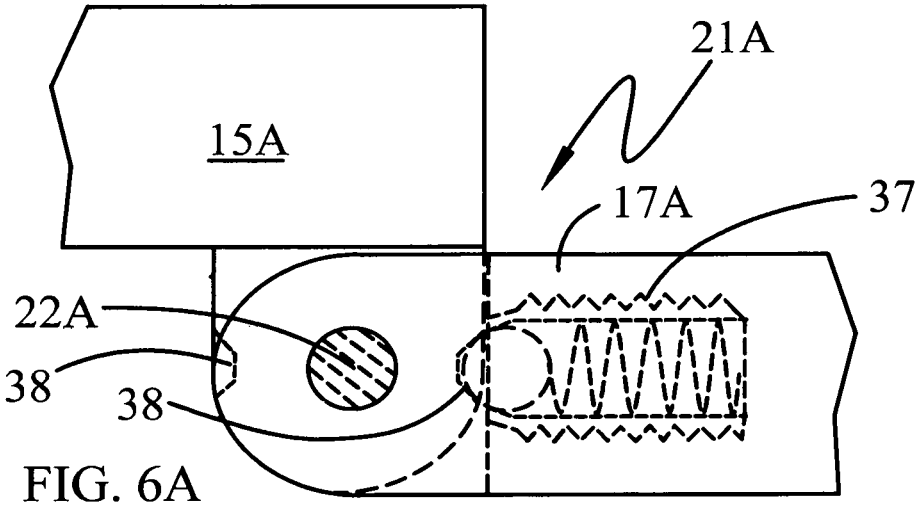

A fourth way to have the system stay in the desired positions is shown in FIGS. 6 and 6A by using a ball spring plunger 37. FIG. 6 is a side view of hinge 21A and FIG. 6A is a top view of hinge 21A which is similar in design to hinge 21 as shown in FIG. 1 but does not have the friction washer 23 and does have the addition of plunger 37. The plunger 37 is screwed into the arm 17A which pivots about pivot pin 22A. Push in plungers are available that simply slide into the a drilled hole rather than using a threaded hole. The base 15A has holes 38 drilled as shown to receive the ball of the plunger 37. The holes 38 are to correspond with having the arm 17A being aligned so the plunger 37 will detent at the two positions use and nonuse. There are still other types of detents and other methods available for having the use and nonuse positions held.

There are other embodiments, variations and alternatives of and for the pivoting toilet paper holder system 10 that will be describe in the following pages along with corresponding figures. In the following figures a stop assist 19 will be added to some of the systems. The stop assist 19 is a novel multifunction structure that is positioned at the end of a roll support 18 as in FIG. 2 to stop the toilet paper 20 from falling off the support. An exploded view with a detailed description can be found in FIG. 2A. The operation of the stop assist 19 can be found in FIGS. 4 through 4D.

Figure 7:
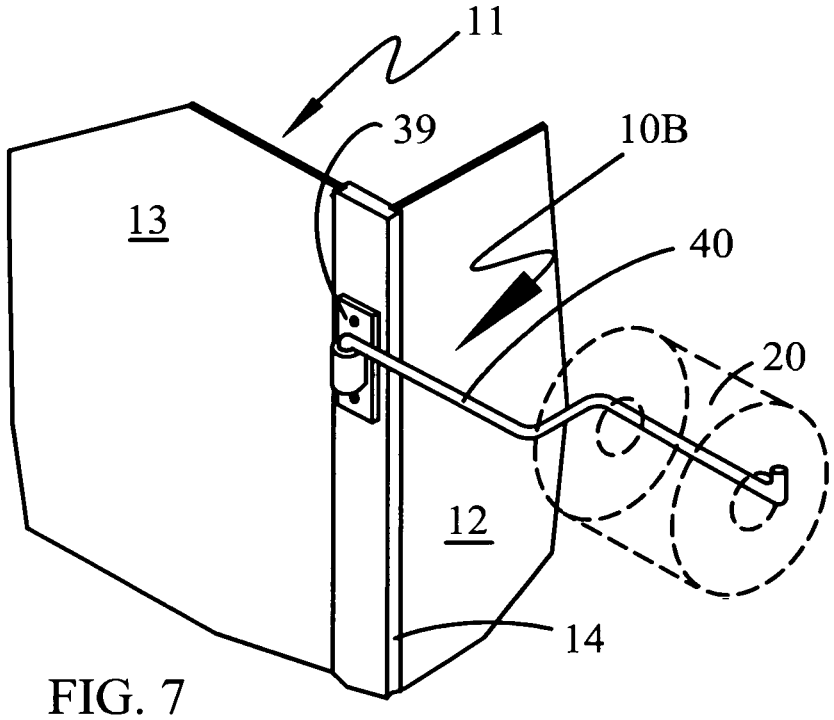
FIG. 7 perspective view system 10B, 1 piece arm.

In FIG. 7, system 10B is shown using a base 39 mounted to the corner 14 of cabinet 11. The arm 40 is made as a one piece structure using bends to accomplish the objective of this invention. The arm 40 pivots from the nonuse position that is right up next to the side 13 of the cabinet 11 to the use position that is forward and around to the front 12 the of cabinet 11. The proximal end of the arm 40 is hinge connected to the base 39. The first L-shaded bend puts the roll 20 around the corner 14 of the cabinet 11. The first L-shaped bend also keeps the roll 20 forward. The distal end of the arm 40 has an L-shaped bend going up to be a means for keeping the toilet paper 20 from falling off. The end of the bend facing upward is short enough to allow a roll 20 to be slid over it so it can be installed between the distal end and the first L-shaped bend of arm 40.

Figure 7A:
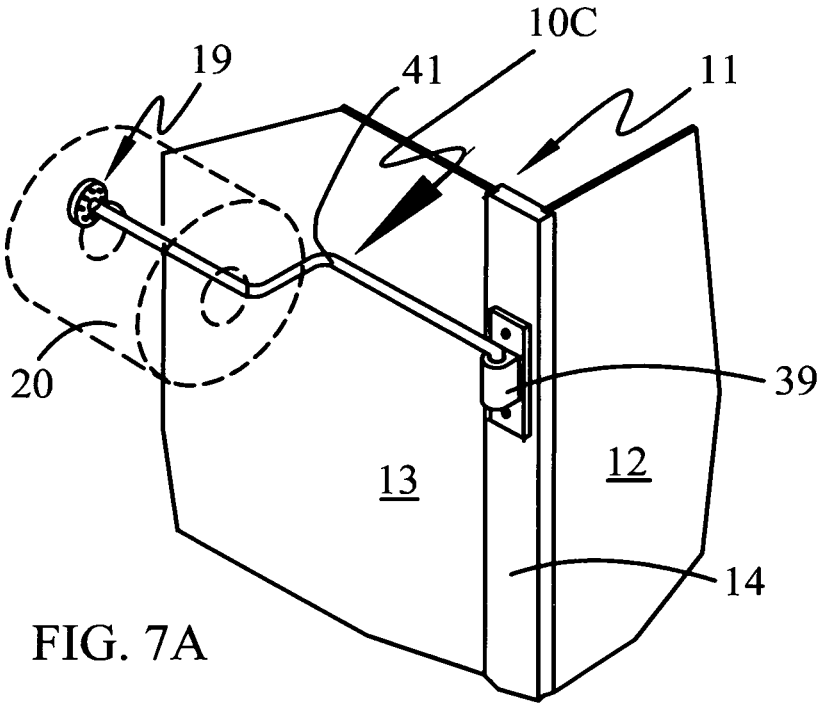
FIG. 7A perspective view system 10C, 1 piece arm, SA.

In FIG. 7A, system 10C is made exactly like system 10B with one exception, where the arm 40 of system 10B uses a means for keeping the roll 20 from falling off, system 10C uses a stop assist 19 to hold the roll 20 on that is attached to the distal end of arm 41.

Figure 8:
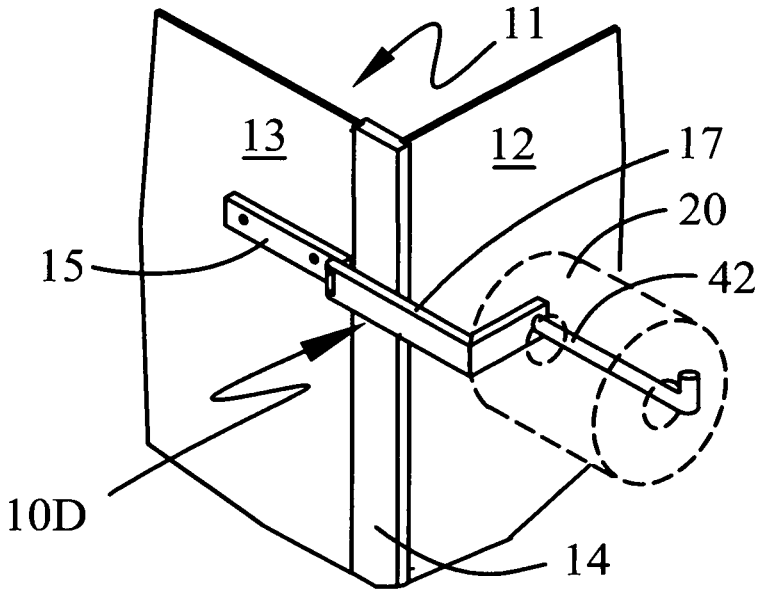
FIG. 8 perspective view system 10D, 2 piece arm.

In FIG. 8, system 10D is made exactly like the preferred embodiment in FIG. 1, except system 10D uses a means for keeping the roll 20 from falling off by having toilet paper roll support 42 at the distal end have an L-shaped bend facing up to keep roll 20 from falling off and having the L-shaped bend also be short enough to allow a roll 20 to be slid over it to be installed.

Figure 8A:
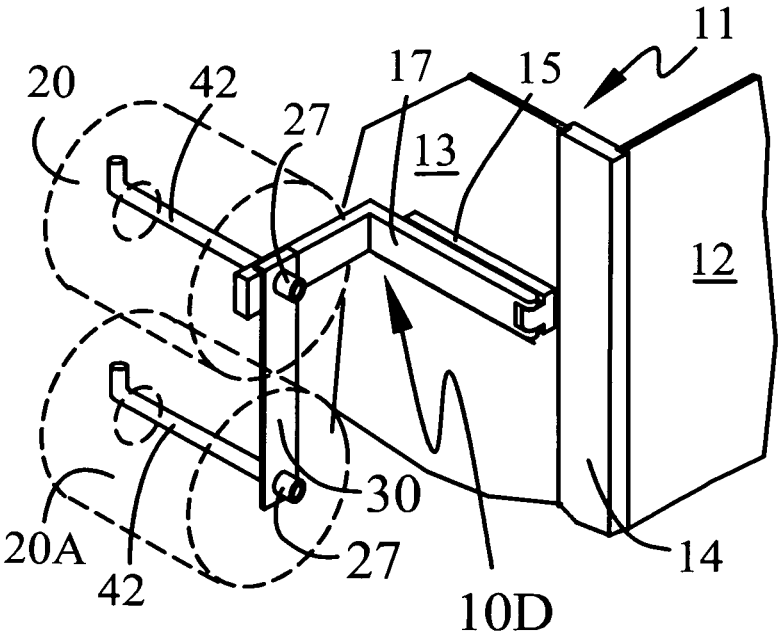
FIG. 8A perspective view system 10D, 2 piece arm, 2 roll.

In FIG. 8A, system 10D is made with a second roll connector 30 and associated parts that are exactly the same as used in system 10 shown in FIG. 3 with the exception that the roll support 18 used in system 10 in FIG. 3 is replaced with roll support 42 shown in FIG. 8.

Figure 9:
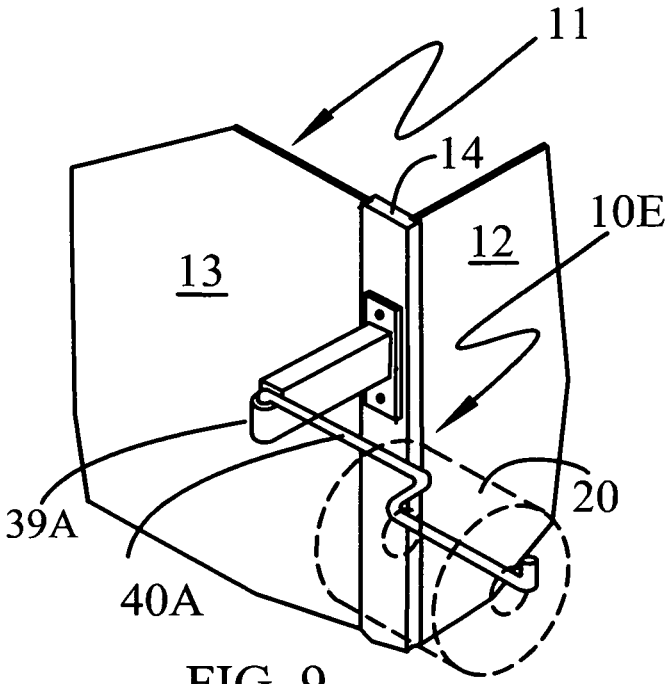
FIG. 9 perspective view system 10E, 1 piece arm, elongated base.

In FIG. 9, system 10E, is exactly the same as system 10B in FIG. 7, with the following exceptions. The base 39A on system 10E is an elongated base and arm 40A on system 10E is the same as the arm 40 on system 10B, except the L-shaped bends of arm 40A of system 10E are in opposite directions than those of arm 40 of system 10B, except the distal bend.

Figure 9A:
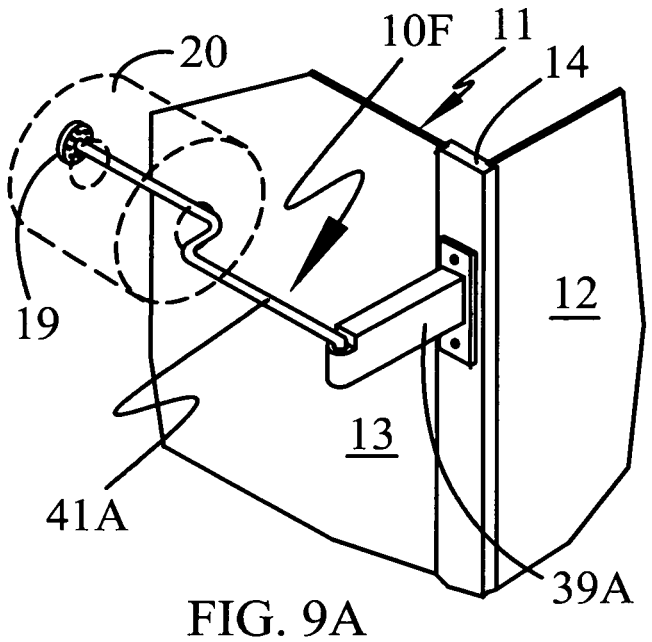
FIG. 9A perspective view system 10F, 1 piece arm, elongated base, SA FIG. 10 perspective view system 10G, 2 piece arm, elongated base.

In FIG. 9A, system 10F, is exactly the same as system 10E, with the following exception, where the arm 40A of system 10E uses a means for keeping the roll 20 from falling off, system 10F uses a stop assist 19 to hold the roll 20 on that is attached to the distal end of arm 41A.

Figure 10:
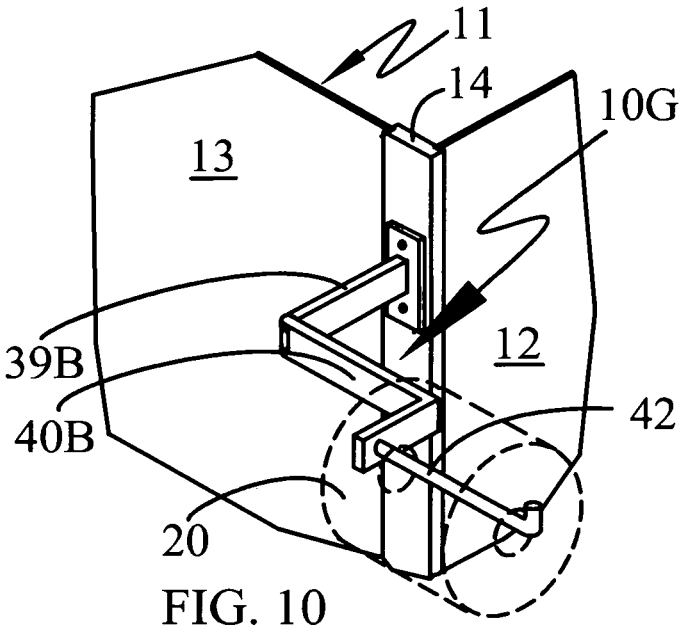
FIG. 10A perspective view system 10H, 2 piece arm, elongated base, SA.

In FIG. 10, system 10G uses an elongated base 39B, and an L-shaped arm 40B in the opposite direction of the L-shaped arm 17 of system 10D in FIG. 8, and roll support 42 as shown and described in system 10D in FIG. 8.

Figure 10A:
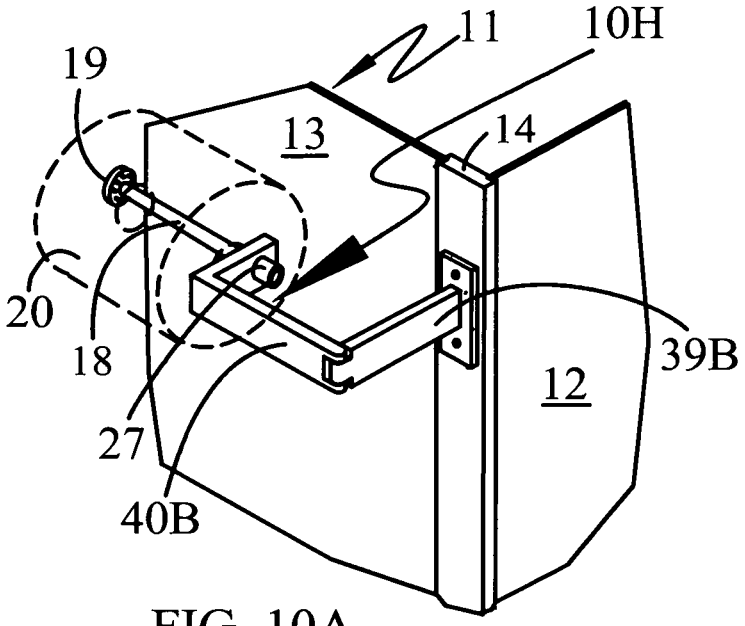

In FIG. 10A, system 10H is exactly the same as system 10G, except roll support 42 is replaced with roll support 18 and stop assist 19 as shown in system 10 in FIGS. 2, 2A.

Figure 11:
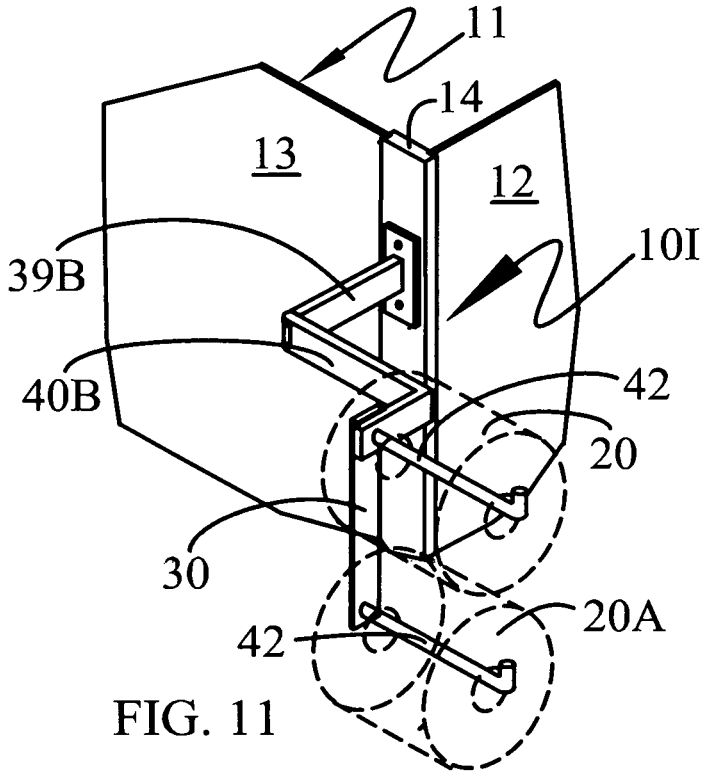
FIG. 11 perspective view system 10I, 2 piece arm, elongated base, 2 roll.

In FIG. 11, system 10I is exactly the same as system as system 10G in FIG. 10, but includes a second roll capability using the same parts as system 10D shown in FIG. 8A for the addition of a second roll 20A.

Figure 11A:
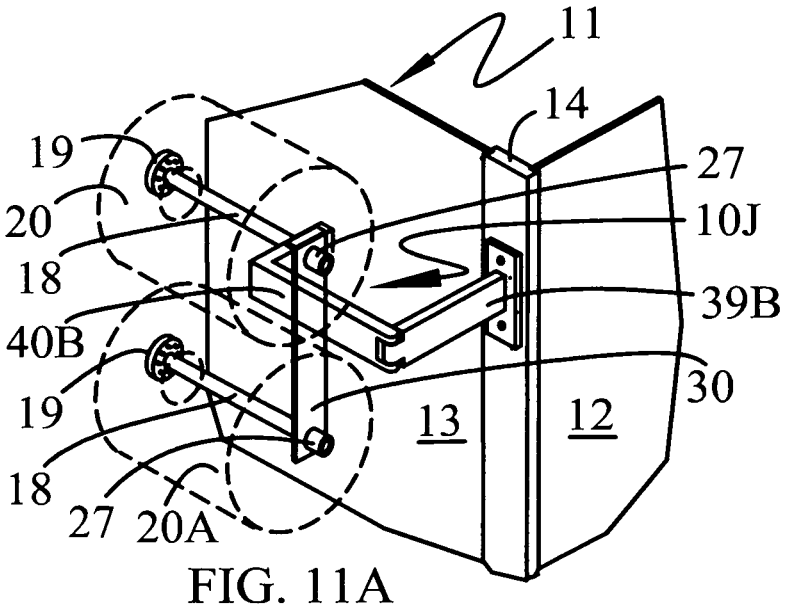
FIG. 11A perspective view sys 10J, 2 piece arm, elongated base, 2 roll, SA.

In FIG. 11A, system 10J is exactly the same as system 10H in FIG. 10A, but includes a second roll 20A capability using the same parts as system 10 in FIG. 3 for the addition of a second roll 20A.

Figure 12:
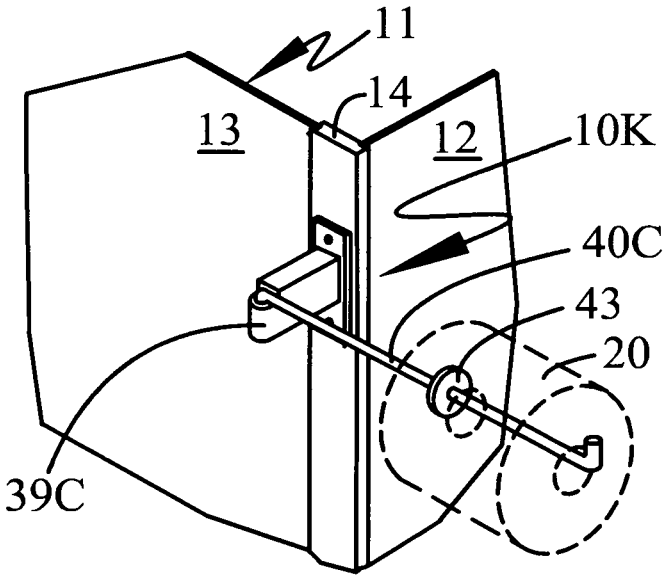
FIG. 12 perspective view system 10K, 1 piece arm, elongated base.

In FIG. 12, system 10K uses a straight pivoting arm 40C attached to an elongated base 39C at one end and between said one end and the distal end of arm 40C, a stop limit 43 used to keep a roll 20 between said limit 43 and the distal end of the arm 40C. At the distal end of 39C a structure with means for installing and retaining roll 20.

Figure 12A:
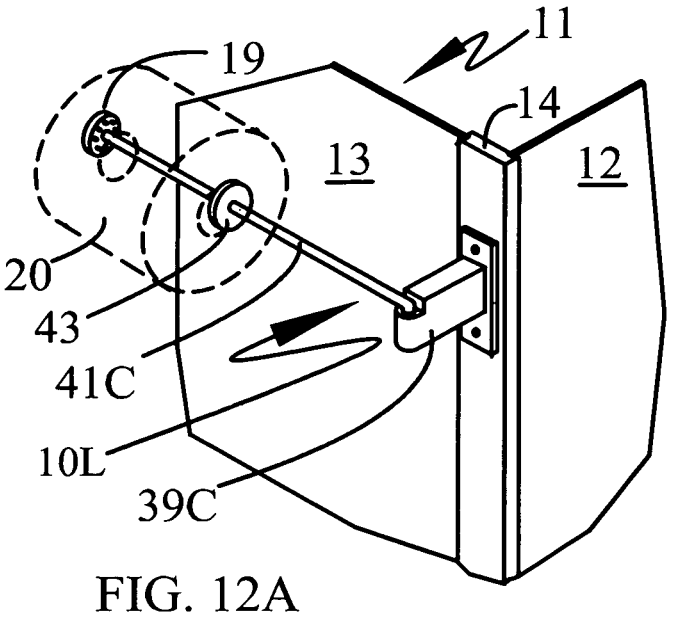
FIG. 12A perspective view system 10L, 1 piece arm, elongated base, SA.

In FIG. 12A, system 10L is exactly the same as system 10K in FIG. 12, with the exception that system 10L uses a straight arm 41C that has a stop assist 19 at the distal end and a stop limit 43 between the end that is attached to base 39C and the stop assist 19 to keep the roll 20 between the stop limit 43 and stop assist 19.

I claim:

1. A pivoting toilet paper roll holder system providing easy access to toilet paper roll in a variety of bathroom layouts, with a use position and a nonuse position mounted on a vertical surface alongside a toilet, comprising:

a base to mount said system to said vertical surface, wherein said base having a means for a hinge attachment; and a rigid arm structure having a first end, and a second end, having between said first end, and said second end, a first bend, and a second bend, wherein said first end is hinge attached to said base, and said first bend is a fixed shape bend formed at an angle towards the toilet when said system is in the nonuse position, and said second bend is a fixed shape bend formed at an angle that is substantially the same said angle as said first bend however said second bend angle is formed in the opposite direction of the angle of said first bend, and wherein between said second bend, and said second end of said rigid arm structure is a place for supporting said toilet paper roll, and said second end having a means for retaining said toilet paper roll.

2. The system as set forth in claim 1, wherein said second bend further comprises a toilet paper roll support having a first end, and a second end, wherein said first end of said toilet paper roll support is attached to said rigid arm structure between said first bend of said rigid arm structure, and said second end of said rigid arm structure forming said second bend of said rigid arm structure at a fixed angle formed at substantially the same said angle as said first bend of said rigid arm structure however the fixed angle of said formed second bend is formed in the opposite direction of the angle of said first bend of said rigid arm structure, and said second end of said toilet paper roll support having a means for retaining said toilet paper roll.

3. The system as set forth in claim 2, further comprising a second roll structure for a second toilet paper roll comprising a rigid connector structure having two ends, a first end, and a second end, wherein said first end of said rigid connector structure is rigidly attached to said rigid arm structure and further comprises a second toilet paper roll support having a first end, and a second end, wherein said first end of said second toilet paper roll support is rigidly attached to said second end of said rigid connector structure, and said second end of said second toilet paper roll support having a means for retaining said second toilet paper roll.

4. The system as set forth in claim 3, wherein said second end of said second toilet paper roll support having a means for retaining said second toilet paper roll is a stop assist comprising a stop assist structure large enough to retain said second toilet paper roll and small enough for said second toilet paper roll to slip over said stop assist structure, and said stop assist structure further comprising a plurality of pegs wherein said pegs are protruding from said stop assist structure and said pegs a pointing towards said second toilet paper roll.

5. The system as set forth in claim 2, wherein said second end of said toilet paper roll support having a means for retaining said toilet paper roll is a stop assist comprising a stop assist structure large enough to retain said toilet paper roll and small enough for said toilet paper roll to slip over said stop assist structure, and said stop assist structure further comprising a plurality of pegs wherein said pegs are protruding from said stop assist structure and said pegs are pointing towards said toilet paper roll.

6. The system as set forth in claim 1, wherein said second end having a means for retaining said toilet paper roll is a stop assist comprising a stop assist structure large enough to retain said toilet paper roll and small enough for said toilet paper roll to slip over said stop assist structure, and said stop assist structure further comprising a plurality of pegs wherein said pegs are protruding from said stop assist structure and said pegs are pointing towards said toilet paper roll.

7. A pivoting toilet paper roll holder system providing easy access to a toilet paper roll in a variety of bathroom layouts, with a use position and a nonuse position mounted on a vertical surface alongside a toilet, comprising:

a base to mount said system to said vertical surface, wherein said base having a rigid elongated structure protruding away from said vertical surface, and said structure having a distal end, and said distal end having a means for a hinge attachment, and a rigid arm structure having a first end, and a second end, having between said first end, and said second, end a first bend, and a second bend, wherein said first end is hinge attached to said base, and said first bend is a fixed shape bend formed at an angle towards the toilet when said system is in the use position, and said second bend is a fixed shape bend formed at an angle that is substantially the same said angle as said first bend however said second bend angle is formed in the opposite direction of the angle of said first bend, and wherein between said second bend, and said second end of said rigid arm structure is a place for supporting said toilet paper roll, and said second end having a means for retaining said toilet paper roll.

8. The system as set forth in claim 7, wherein said second bend further comprises a toilet paper roll support having a first end, and a second end, wherein said first end of said toilet paper roll support is attached to said rigid arm structure between said first end of said rigid arm structure, and said second end of said rigid arm structure forming said second bend of said rigid arm structure at a fixed angle formed at substantially the same said angle as said first bend of said rigid arm structure however the fixed angle of said formed second bend is formed in the opposite direction of the angle of said first bend of said rigid arm structure, and said second end of said toilet paper roll support having a means for retaining said toilet paper roll.

9. The system as set forth in claim 8, further comprising a second roll structure for a second toilet paper roll comprising: a rigid connector structure having two ends, a first end, and a second end, wherein said first end of said rigid connector structure is rigidly attached to said rigid arm structure, and further comprises a second toilet paper roll support having a first end, and a second end, wherein said first end of said second toilet paper roll support is rigidly attached to said second end of said rigid connector structure, and said second end of said second toilet paper roll support having a means for retaining said second toilet paper roll.

10. The system as set forth in claim 9, wherein said second end of said second toilet paper roll support having a means for retaining said second toilet paper roll is a stop assist comprising a stop assist structure large enough to retain said second toilet paper roll and small enough for said toilet paper roll to slip over said stop assist structure, and said step assist structure further comprising a plurality of pegs wherein said pegs are protruding from said stop assist structure and said pegs are pointing towards said second toilet paper roll.

11. The system as set forth in claim 8, wherein said second end of said toilet paper roll support having a means for retaining said toilet paper roll is a stop assist comprising a stop assist structure large enough to retain said toilet paper roll and small enough for said toilet paper roll to slip over said stop assist structure, and said stop assist structure further comprising a plurality of pegs wherein said pegs are protruding from said stop assist structure and said pegs are pointing towards said toilet paper roll.

12. The system as set forth in claim 6, wherein said second end having a means for retaining said toilet paper roll is a stop assist comprising a stop assist structure large enough to retain said toilet paper roll and small enough for said toilet paper roll to slip over said stop assist structure, and said stop assist structure further comprising a plurality of pegs wherein said pegs are protruding from said stop assist structure and said pegs are pointing towards said toilet paper roll.

13. A pivoting toilet paper roll holder system providing easy access to a toilet paper roll in a variety of bathroom layouts, mounted on a vertical surface alongside a toilet, comprising:

a base to mount said system to said vertical surface, wherein said base having a rigid elongated structure protruding away from said vertical surface, and said structure having a distal end, and said distal end having a means for a hinge attachment; and a rigid arm structure having a first end, and a second end having between said first end, and said second end a stop limit, wherein said first end is hinge attached to said base, and said stop limit is a structure stopping movement of said toilet paper beyond said stop limit, and between said stop limit and said second end is a place for supporting said toilet paper roll, and said second end having a means for retaining said toilet paper roll;

wherein said second end having a means for retaining said toilet paper roll is a stop assist comprising a stop assist structure large enough to retain said toilet paper roll and small enough for the said toilet paper roll to slip over said stop assist structure, and said stop assist structure having further comprising a plurality of pegs wherein said pegs are protruding from said stop assist structure and said pegs are pointing towards said toilet paper roll.

* * * * *